US009777683B2

(12) United States Patent
Thomas

(10) Patent No.: US 9,777,683 B2
(45) Date of Patent: Oct. 3, 2017

(54) ENGINE STARTING SYSTEM WITH PURGE PUMP

(71) Applicant: WALBRO ENGINE MANAGEMENT, L.L.C., Tucson, AZ (US)

(72) Inventor: David L. Thomas, Cass City, MI (US)

(73) Assignee: Walbro LLC, Tucson, AZ (US)

( * ) Notice: Subject to any disclaimer, the term of this patent is extended or adjusted under 35 U.S.C. 154(b) by 195 days.

(21) Appl. No.: 14/768,773

(22) PCT Filed: Mar. 11, 2014

(86) PCT No.: PCT/US2014/023604

§ 371 (c)(1),
(2) Date: Aug. 19, 2015

(87) PCT Pub. No.: WO2014/159426

PCT Pub. Date: Oct. 2, 2014

(65) Prior Publication Data

US 2016/0003203 A1 Jan. 7, 2016

Related U.S. Application Data

(60) Provisional application No. 61/785,782, filed on Mar. 14, 2013.

(51) Int. Cl.

| | |
|---|---|
| ***F02M 25/08*** | (2006.01) |
| ***F02M 37/04*** | (2006.01) |
| ***F02M 33/02*** | (2006.01) |
| ***F02M 37/16*** | (2006.01) |

(Continued)

(52) U.S. Cl.
CPC ..... *F02M 37/04* (2013.01); *F02M 25/08* (2013.01); *F02M 33/02* (2013.01); *F02M 37/16* (2013.01); *F02M 1/16* (2013.01); *F02M 33/08* (2013.01)

(58) Field of Classification Search
CPC ..... F02M 25/08; F02M 33/02; F02M 37/04; F02M 1/16; F02M 37/16
See application file for complete search history.

(56) References Cited

U.S. PATENT DOCUMENTS 4,803,963 A * 2/1989 Kleinhans ..... F02M 1/16 123/179.12
5,924,400 A 7/1999 Kobayashi
(Continued)

FOREIGN PATENT DOCUMENTS

| | | |
|---|---|---|
| JP | S61175259 | 8/1986 |
| JP | H03164565 | 7/1991 |
| JP | H04191456 | 7/1992 |

OTHER PUBLICATIONS

Written Opinion & International Search Report for PCT/US2014/023604 dated Jul. 8, 2014, 11 pages.

*Primary Examiner* — Hieu T Vo
(74) *Attorney, Agent, or Firm* — Reising Ethington P.C.

(57) ABSTRACT

A starting system for an internal combustion engine that includes: a pump device in communication with a purging and priming circuit of a carburetor; a driven member coupled to the pump device; and a drive member rotatably carried by a recoil starter pulley of an engine. The drive member may positively drive the driven member in two directions, and the driving of the driven member may actuate the pump device.

15 Claims, 4 Drawing Sheets

(51) Int. Cl.
*F02M 1/16* (2006.01)
*F02M 33/08* (2006.01)

(56) References Cited

U.S. PATENT DOCUMENTS

| | | | | |
|---|---|---|---|---|
| 7,275,508 | B2 * | 10/2007 | Pattullo | F02M 1/02 123/179.18 |
| 7,334,551 | B2 * | 2/2008 | Pattullo | F02D 11/02 123/179.18 |
| 7,600,505 | B2 * | 10/2009 | Pattullo | F02M 1/18 123/185.6 |
| 2006/0219225 | A1 | 10/2006 | Pattullo | |

* cited by examiner

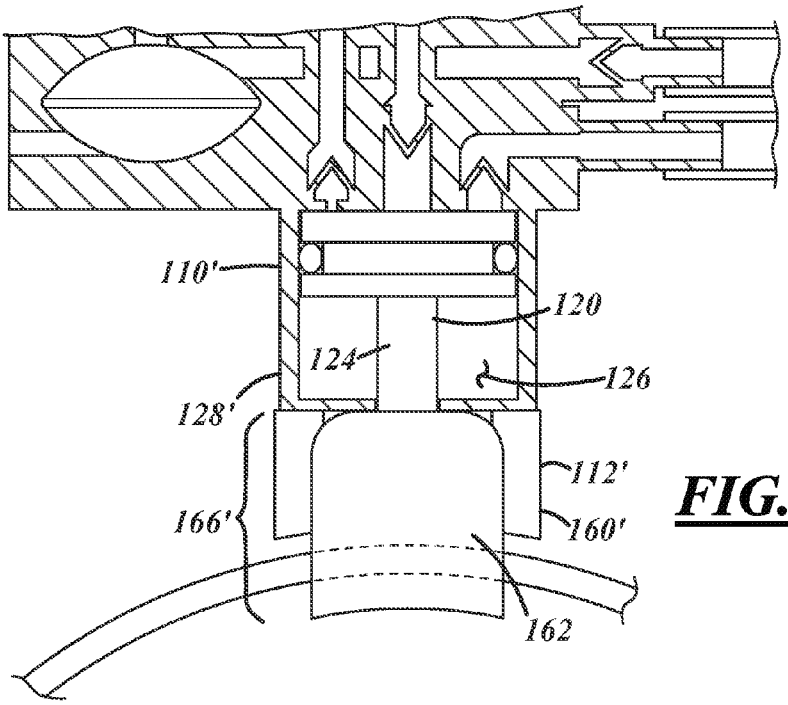
FIG. 8
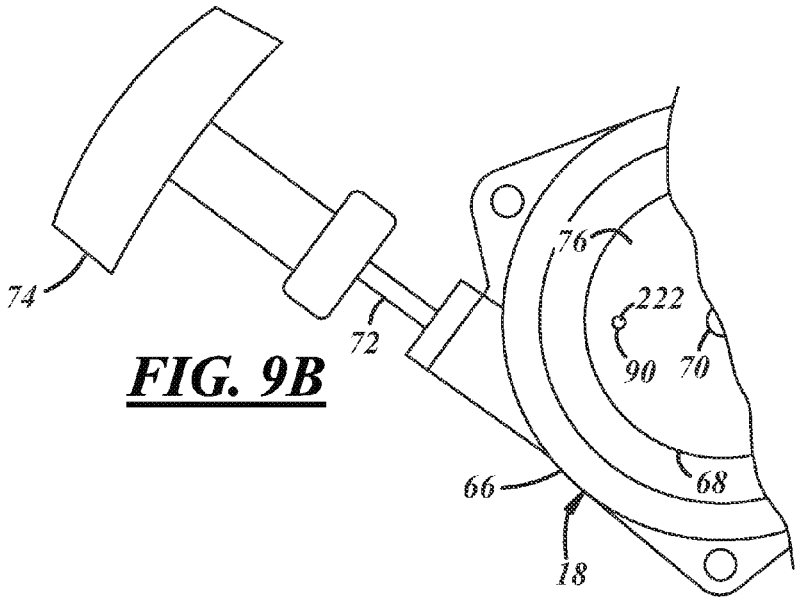
FIG. 9B
FIG. 10
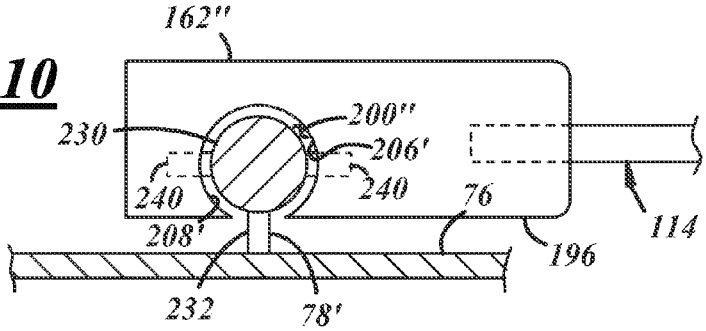

ENGINE STARTING SYSTEM WITH PURGE PUMP

REFERENCE TO CO-PENDING APPLICATION

This application claims the benefit of U.S. Provisional Application No. 61/785,782 filed Mar. 14, 2013, which is incorporated herein by reference in its entirety.

TECHNICAL FIELD

The present disclosure relates generally to fuel systems for small combustion engines, and more particularly to a system for purging the fuel system and starting such engines.

BACKGROUND

Carburetors may be attached to or include a purge and prime pump that is in communication with a carburetor's fuel circuit. Prior to starting an engine with which a carburetor is used, the purge and prime pump may direct stale fuel and fuel vapors through a downstream fuel line to a fuel tank and draw in fresh fuel into the carburetor—e.g., drawing in liquid fuel that is generally free of fuel vapor.

SUMMARY

According to one implementation of the present disclosure, there is provided a starting system for an internal combustion engine that includes: a pump device in communication with a purging and priming circuit of a carburetor; a driven member coupled to the pump device; and a drive member rotatably carried by a recoil starter pulley of an engine. The drive member may positively drive the driven member in two directions, and the driving of the driven member may actuate the pump device According to another implementation of the present disclosure, there is provided a starting system for an internal combustion engine that includes: a pulley rotatable about an axis; a drive member rotatable with the pulley; a carburetor in fluid communication with the engine and having a purging and priming circuit through which fluid flows to do one or both of purge stale fluid from the carburetor and prime the carburetor with fuel; and a pump assembly. The pump assembly may have a driven member engageable with the drive member to displace the driven member as the drive member rotates with the pulley. In addition, at least one of the drive member or the driven member may have cam surfaces to actuate the driven member in opposed directions as the drive member rotates. The pump assembly may include a pump device that is actuated by movement of the driven member to pump fluid in the purging and priming circuit.

BRIEF DESCRIPTION OF THE DRAWINGS

The following detailed description of preferred embodiments and best mode will be set forth with reference to the accompanying drawings, in which:

FIG. 8 is a fragmentary view of another implementation the pump assembly shown in FIG. 1;

FIG. 9B is a fragmentary view of another implementation of the recoil starter assembly shown in FIG. 1; and FIG. 10 is a fragmentary sectional view of another implementation of the recoil starter assembly shown in FIG. 1.

DETAILED DESCRIPTION OF PREFERRED EMBODIMENTS

Figure 1:
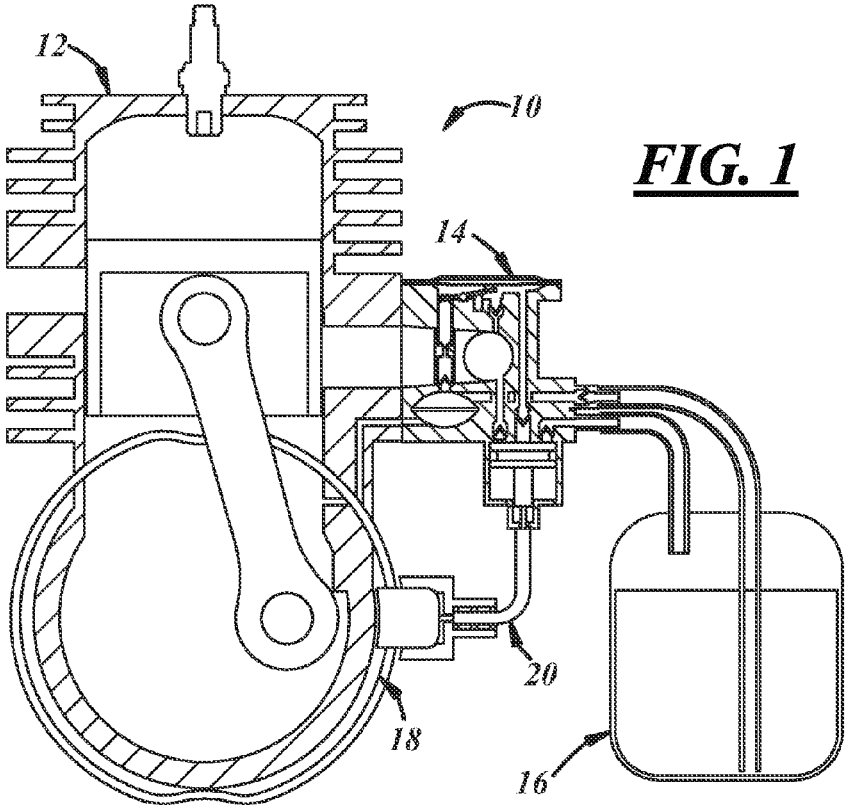
FIG. 1 is a schematic sectional view of an engine, a carburetor, a recoil starter assembly, a fuel tank, and a pump assembly according to one implementation.

Referring in more detail to the drawings, FIG. 1 illustrates an engine recoil start and fuel system 10. The system 10 includes an engine 12 having a carburetor 14 in fluid communication with a fuel tank 16 and a recoil starter assembly 18 (for starting the engine 12). The carburetor 14 and the recoil starter assembly 18 may be operably coupled to one another using a pump assembly 20 that purges stale fuel and/or vapor from the carburetor 14 and may also prime the carburetor with fresh fuel prior to starting the engine 12. The pump assembly 20 is driven by the recoil starter assembly 18 during actuation of the recoil starter assembly to start the engine. Hence, purging the carburetor 14 may occur automatically as the engine 12 is started. Various implementations of the engine 12 and the fuel tank 16 will be appreciated by skilled artisans; in at least one implementation, the engine and fuel tank provided may be for small engine machines such as lawn trimmers, chainsaws, motorbikes, outboard marine engines, etc.

Figure 2:
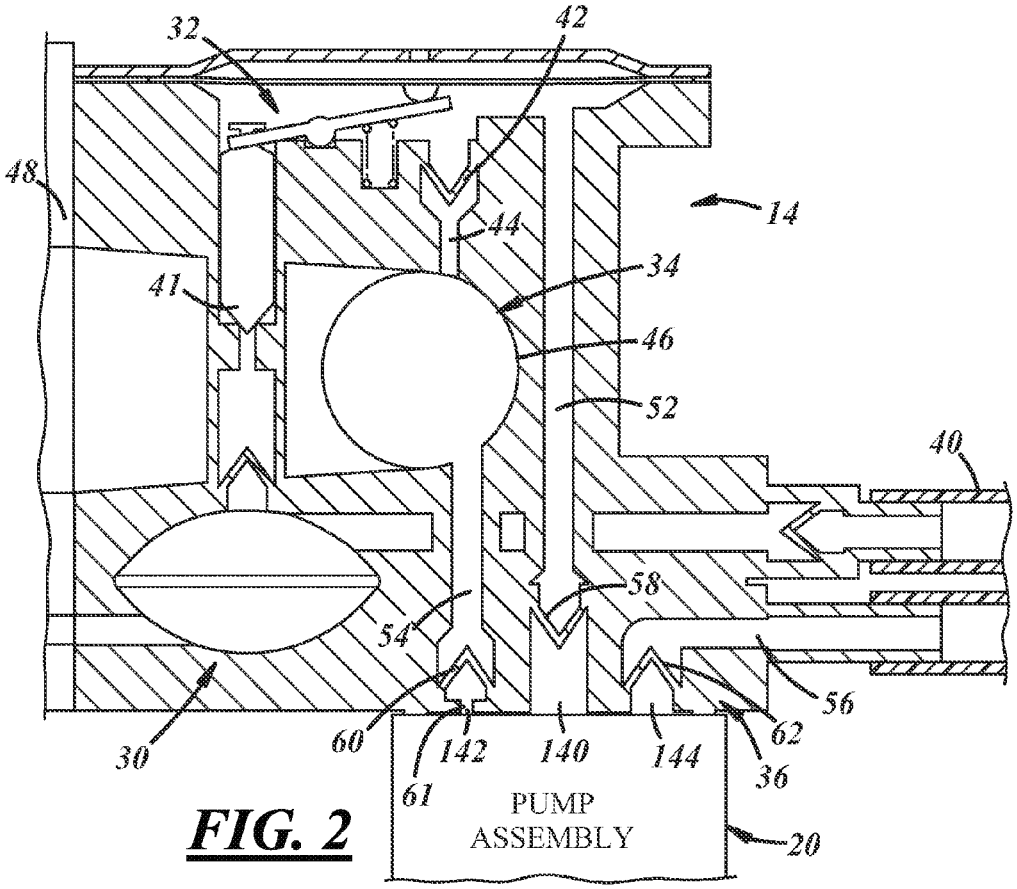
FIG. 2 is a schematic view of the carburetor of FIG. 1.

Carburetor technology is also known, and carburetor 14 may be any suitable carburetor. The carburetor 14 illustrated in FIG. 2 is a diaphragm-type carburetor having a pumping assembly 30, a metering assembly 32, a mixing assembly 34, and a purging and priming circuit 36. As will be appreciated by skilled artisans, the pumping assembly 30 may receive fuel from the fuel tank 16 via an inlet passage 40 and deliver the fuel to the metering assembly 32 via an inlet needle 41. According to the demands of the engine 12, the metering assembly 32 may deliver fuel through a one-way check valve 42 and a passage 44 that communicates with a main intake bore 46 of the mixing assembly 34. The mixing assembly 34 may include one or more passages, ports, and/or nozzles through which fuel is routed to the intake bore 46 for mixing with air flowing through the intake bore. A fuel-air mixture in the mixing assembly 34 may be delivered to the engine 12 via an intake manifold 48.

The purging and priming circuit 36 may include a number of fluid passages 52, 54, 56 communicated with the pump assembly 20. A fuel chamber of the metering system 32 may be in communication with the pump assembly 20 via the inlet passage 52 and a one-way check valve 58 may be provided to inhibit or prevent fluid flow from the pump assembly 20 to the metering system 32. The outlet passage 54 from the pump assembly 20 may allow fluid communication from the pump assembly 20 through a one-way check valve 60 to the intake bore 46 (the valve 60 inhibiting or preventing reverse flow from the intake bore 46 to the pump assembly). In at least one implementation, a restriction 61 may be provided in passage 54 to control the flow rate through the outlet passage 54. And the outlet passage 56 may be coupled to the filet tank 16 at a distal end (or to another location, such as the intake bore 46) and at the proximate end be coupled to the pump assembly 20. A one-way check valve 62 may allow fluid communication from the pump assembly 20 to the fuel tank 16 but inhibit or prevent reverse flow.

Figure 3:
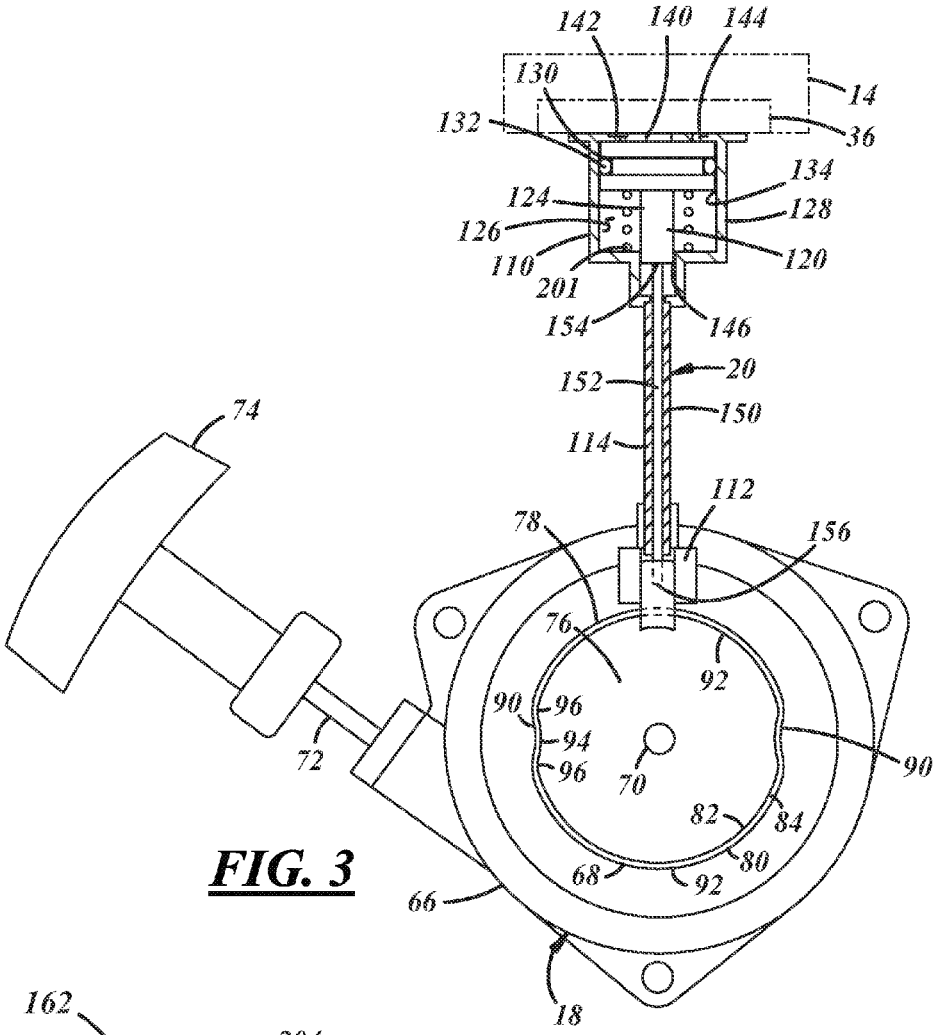
FIG. 3 is a schematic view of the recoil starter assembly and the pump assembly of FIG. 1.

Fluid flow in and through the purging and priming circuit 36 is driven by the pump assembly 20 which, in turn, is driven by the recoil starter assembly 18. As shown in FIG. 3, the recoil starter assembly 18 may include a housing 66 and a recoil pulley 68 carried by the housing 66 for rotation about an axis 70. The pulley 68 is designed to have a pull cord 72 wound thereon with a free end of the pull cord 72 extended through an opening in the housing 66 and terminating at a user pull handle 74.

The recoil pulley 68 has a body 76 that carries or defines at least part of a drive member or cam. In the illustrated implementation, the cam is defined by a flange 78 or rail that extends from and is connected to the body 76 for rotation with the body. The flange 78 may be generally circumferentially continuous, although gaps or spaces may be provided, if desired. The flange 78 may be located at and/or define a periphery of the body 76, or it could be inset therefrom, and could be, although need not be, symmetric relative to axis 70. The flange 78 may have two surfaces, a first surface 80 and a second surface 82, that extend outwardly to an edge 84. The first surface 80 may face radially outwardly and the second surface 82 radially inwardly. In the illustrated implementation, both surfaces 80, 82 are generally parallel to one another along their circumferential extents and the edge 84 is flat and defines the width of the flange; however this is not required (e.g., the surfaces may not be parallel along at least a portion of their circumferential extent and the edge 84 may be rounded or angular).

The flange 78 may have one or more radial variations or deviations or driving portions 90 located thereon. The driving portions 90 may be any sort of radial shift, deviation, recession, protrusion, or indentation (inwardly or outwardly) along the length of the flange 78, and the driving portions 90 may have at least two portions—a first portion 94 and a second portion 96, the first portion being radially inward of the second portion. The flange 78 may also have one or more nondriving portions 92, i.e., regions of the flange 78 that do not radially vary with respect to the axis 70; however, some implementations may have no nondriving portions. In the illustrated implementation, there is shown two nondriving portions and two driving portions. The nondriving portions 92 of the flange 78 have a constant radius, and the driving portions 90 are radially inwardly curvilinear recesses—the illustrated recesses having two second portions 96 and one first portion 94. For example, at a second portion 96 (adjacent the nondriving portion 92), the driving portions 90 may begin to gradually or smoothly deviate radially inwardly to a first portion 94, and then may begin to gradually or smoothly deviate outwardly to the second portion 96 (adjacent another nondriving portion 92). In FIG. 3, the two driving portions 90 are illustrated approximately 180° from one another, the second portions of each of the driving portions 90 are approximately radially equidistant from the axis 70, and the second portions are approximately equidistant to the nondriving portions 92; however, other quantities and arrangements are also possible.

FIG. 3 also illustrates the pump assembly 20 which converts the rotary motion of the recoil starter assembly 18 to a pumping action that is communicated with the purging and priming circuit 36 of the carburetor 14. The pump assembly 20 may include a pump or pumping device 110 in communication with the purging and priming circuit 36 and an actuator 112 coupled to the pumping device 110 via a transmission device 114.

The pumping device 110 may include any type of pump; here, the pumping device is illustrated as a piston 120 coupled to an axial rod 124 within a pump housing 128. The piston 120 may have a circumferential groove 130 sized for an O-ring 132 enabling the piston 120 to sealably slide against an interior surface 134 of the housing 128. A pump chamber 126 is defined between the piston 120 and housing 128 and is communicated with the carburetor passages 52, 54, 56 via passages or ports 140, 142, 144 (see also FIG. 2). The other end of the housing 128 may also be closed with the exception of an opening 146 sized to receive the transmission device 114.

The transmission device 114 may include a cover or housing 150 and a drive member 152. Here, by way of example, the cover 150 is illustrated as a tubular conduit and the drive member 152 is illustrated as an inner wire (e.g., the transmission device may be a Bowden cable). The inner wire 152 may be connected at a first end 154 to the piston rod 124 and at a second end 156 to the actuator 112. In other implementations, the drive member 152 of the transmission device may be a rigid rod or tube. And other implementations also may be used.

Figure 4:
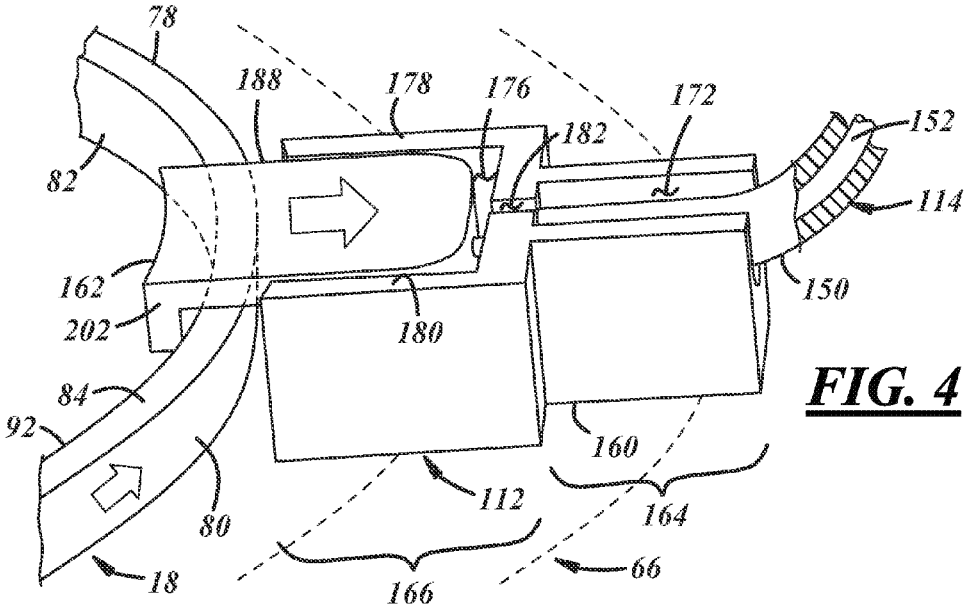
FIG. 4 is a fragmentary perspective view of portions of the recoil starter assembly and the pump assembly.
Figure 5:
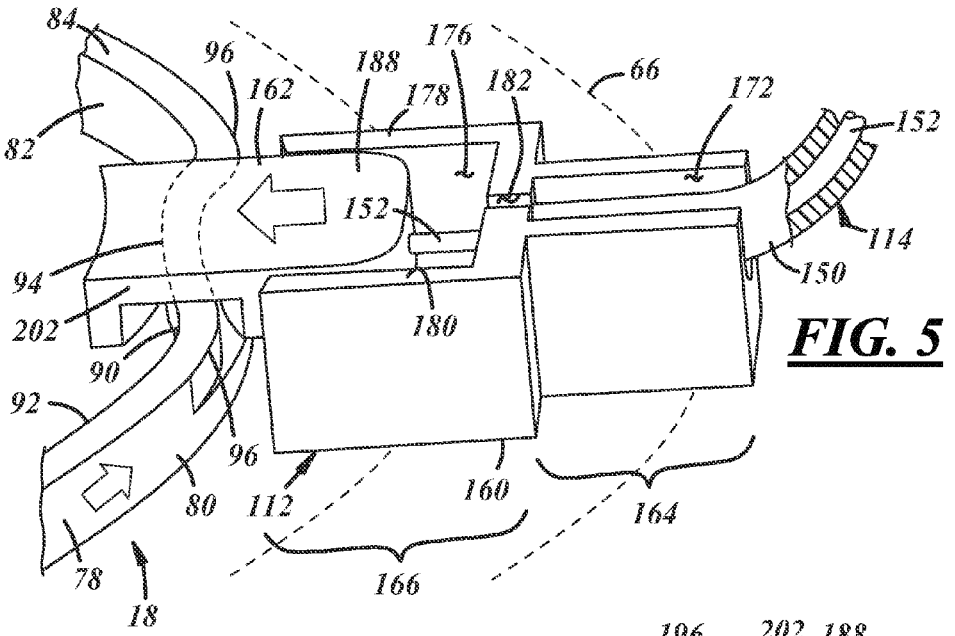
FIG. 5 is another fragmentary perspective view of the recoil starter assembly and the pump assembly.

As shown in FIGS. 3-5, the actuator 112 couples the transmission device 114 to the recoil starter assembly 18 and may include a housing 160 and a driven member or cam follower 162. The housing 160 may be fixedly attached, connected, or coupled to the housing 66 of the recoil starter assembly 18 or to and/or through an opening (not shown) therein. The housing 160 may include a first section 164 and a second section 166. The first section 164 may include an opening or passage 172 through which the transmission device 114 extends and it may have features and/or appurtenances for securing the conduit 150 of the transmission device 114. The second section 166 may have a chamber 176 defined in part by opposed walls 178, 180 that receive and guide the follower 162 for linear reciprocation relative to the housing 160. A passage 182 communicates the first and second sections 164, 166, and the drive member 152 extends through the passage 182. Drive member 152 is connected to the follower 162 so that the drive member moves as the follower moves.

Figure 6:
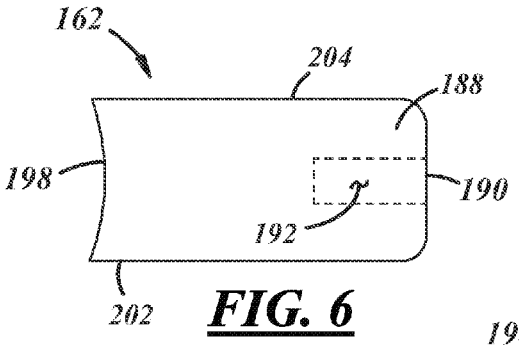
FIG. 6 is a top view of a driven member of the pump assembly.
Figure 7:
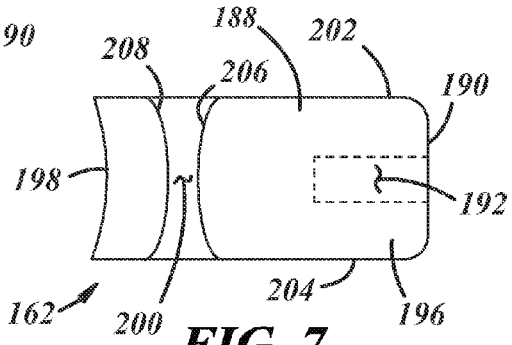
FIG. 7 is a bottom view of the driven member of FIG. 6.

The follower 162 (also shown in FIGS. 6 and 7) may have a body 188 with a first end 190 having a cavity or channel 192 sized to receive the second end 156 of the inner wire 152. The follower 162 is illustrated as a generally rectangularly-shaped body; however, the body 188 may have other shapes (e.g., cylindrical, cubical, etc.) A bottom or bottom surface 196 of the follower 162 may have a groove 200 therein between the first end 190 and a second or distal end 198. The groove 200 may extend from a first side 202 of the follower 162 to a second side 204, and may be defined in part by a first wail or surface 206 nearer the first end 190 and a second wall or surface 208 nearer the second end 198. The first and second walls 206, 208 may be straight, curved, or angular; however, in at least one implementation, the first and second walls 206, 208 are convexly-shaped curves that face one another defining an hourglass-shaped groove 200. The spacing between the first and second walls 206, 208 may be at least slightly larger than the maximum width of the flange 78 of the recoil starter assembly 18. In assembly, the flange 78 is received within the groove 200, and the flange 78 slides relative to the actuator 112 when the recoil pulley 68 is rotated.

The follower 162 may be formed of plastic, metal, or any other suitable material and may be formed in one piece so that each described feature is integral to and formed in the one piece, if desired. Other shapes and arrangements may be used to drive an actuator when the recoil pulley is rotated. For example, while described as having cam surfaces with radial deviations, the cam could have cam surfaces with axial deviations to drive the follower axially as the recoil pulley rotates.

In operation, the pump assembly 20 may be actuated during operation of the recoil starter assembly 18 to purge the carburetor 14 of stale fuel and vapors and/or to prime the carburetor with fresh fuel. When the pull handle 74 of the recoil starter assembly 18 is pulled by a user, as will be appreciated by skilled artisans, the recoil pulley 68 will rotate in a first direction (e.g., clockwise in the top view of FIG. 3) as the pull cord 72 is drawn from the recoil starter housing 66. As the recoil pulley 68 rotates, the flange 78 passes through the actuator 112—more specifically, the flange 78 passes through the groove 200 in the follower 162. When the nondriving portions 92 of the flange 78 are passing through the groove 200 of the follower 162, the follower may remain in an unactuated or nominal position (e.g., see FIG. 4). And when one of the driving portions 90 of the flange 78 passes through the groove 200—more specifically, when one of the second portions 96 passes through the groove 200 followed by one of the first portions 94, the follower 162 is displaced radially inwardly with respect to the axis 70 of the recoil starter assembly 18 (e.g., see FIG. 5). And when one of the first portions 94 passes through the groove 200 followed by one of the second portions 96, the follower 162 is displaced radially outwardly.

The recoil pulley 68 may experience a number of rotations as the pull cord is drawn to its full length (or nearly full length); thus, the driving portions 90 may pass through the follower 162 numerous times, and each time one of the driving portions 90 passes therethrough, the follower may experience a reciprocation or cycle radially inwardly and/or radially outwardly with respect to the second section 166 of the actuator housing 160. In addition, as will be appreciated by skilled artisans, when the user releases the tension on the pull cord 72, the recoil pulley 68 may rotate in a second direction (e.g., counterclockwise) as the pull cord retracts into the housing 66 (e.g., according to a spring tension) And as the recoil pulley 68 rotates in the second direction, the driving portions 90 may pass through the groove 200 of the follower 162 numerous times again and the follower may again reciprocate numerous times back and forth.

As the follower 162 reciprocates, the inner wire 152 which is fixed to the follower, may slidably move within the cover 150 of the transmission device 114 transmitting a pushing force and a pulling force to the piston 120 of the pumping device 110. This displaces the piston 120 back and forth within the pump chamber 126 to vary the volume of the pump chamber. If desired, in at least some implementations a spring 201 (FIG. 3) may act on the piston 120 to assist its movement.

As the piston 120 is pushed toward the carburetor and pulled away from the carburetor, the carburetor 14 may be purged of stale fuel and fuel vapors and may be primed with fresh fuel. In one implementation, the process or method of purging and priming may occur only when the piston 120 is actuated and therefore only when the recoil starter assembly 18 is actuated using the pull handle 74; i.e., once the engine 12 is running, no purging or priming may be necessary. The operation of purging and priming circuits are known; therefore, the following description is given only by way of example.

When the piston 120 is pushed (toward the carburetor 14), any fluid within the pump chamber 126 will be pushed into the passages 54 and 56 and through their respective one-way check valves 60 and 62. Since the outlet passage 54 may include the restriction 61, the majority of the fluid may be forced through the opening 144 and through the outlet passage 56 returning it to the fuel tank (or other location as noted above). When the piston is pulled (away from the carburetor 14), the one-way check valve 58 may open allowing fuel within the metering system 32 and the passage 52 to be drawn into the chamber 126. In addition, fuel may be drawn from the fuel tank 16, through the inlet passage 40, through the pumping assembly 30, and into the metering system 32. As additional pushing and pulling strokes of the piston 120 are completed, most of the stale fuel and vapor may be returned to the fuel tank 16 thereby purging the carburetor. The pumping assembly 30, metering system 32, and various other passages may gradually be supplied with fresh fuel drawn from the fuel tank 16. And eventually, fresh fuel may enter the pump chamber 126 and may be expelled into the intake bore 46 via the outlet passage 54 and the one-way check valve 60 thereby priming the carburetor 14 for ignition.

The radially inward displacement of the follower 162 may be approximately equal to the axial or longitudinal displacement of the piston 120 drawing fluid into the pump chamber 126. Similarly, the radially outward displacement of the follower 162 may be approximately equal to the axial or longitudinal displacement of the piston 120 expelling fluid from the chamber 126. And because the follower is positively driven in both inward and outward directions, the magnitude of the displacement of the follower 162 (e.g., its stroke length) is relatively constant regardless of the rotary speed of the recoil pulley 68. In addition, since the cam follower 162 is actuated in both directions of its movement (e.g., due to the positive mechanical engagement in both directions), the timing of fill strokes of the piston 120 is assured. Therefore, the present implementation need not rely upon a mechanism (such as a spring) to bias and drive the pump in one direction. Relying upon a spring or other device not driven by the recoil pulley can result in a limited pump response rate (e.g. rate of a pump return stroke) and result in less than complete strokes of the pump, and thereby reduce the efficiency of the pump.

Other implementations also exist. For example, FIG. 8 illustrates an implementation absent the transmission device 114. In this implementation, the rod 124 of the piston 120 may be directly coupled to the follower 162, and a second section 166' of an actuator housing 160' may be coupled directly to or defined as part of a housing 128' of a pump device 110'.

Figure 9A:
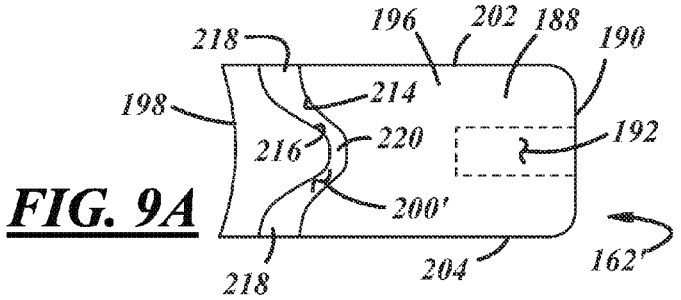
FIG. 9A is a bottom view of another implementation of the driven member shown in FIG. 1.

In addition, other pumping device implementations may exist (e.g., other piston arrangements, a diaphragm pump arrangement, etc.) and other cam and cam follower arrangements may exist. In the previously described implementations, the cam has been described as having cam surfaces (e.g., 80, 82) for driving the follower as the cam is rotated; however, this is not necessary. For example, the cam follower may have cam surfaces for driving the follower during cam rotation. FIG. 9A illustrates a cam follower 162' having a groove 200' defined by a first cam surface 214 115 nearer the first end 190 and a second cam surface 2116 nearer the second end 1198. The groove 200' may extend from one side 202 to the other side 204. At the side 202, the groove 200' may have a first portion 218 gradually curving to a second portion 220 (toward the first end 190). From the second portion 220, the groove 200' may then gradually curve to another first portion 218 at the other side 204 (toward the second end 192).

The cam follower 162' may engage a cam on the recoil pulley 68. As shown in FIG. 9B, the cam may be defined by a peg 222 or pin or similar discrete or segmented structure that extends from or is otherwise carried by the body 76 for rotation with the body. In operation, the recoil pulley may rotate as previously described and the peg 222 may pass through the groove 200'. As the peg 222 passes through the first and second portions, it engages the cam surfaces 214, 216 and the follower 162' may be driven to drive the piston 120 in the pump chamber 126. In this implementation, the follower 162' will be driven outwardly and inwardly once per pulley rotation; however, the body 76 may have more than one peg 222 thereby driving the follower 162' multiple times per rotation. In addition, the shape of the groove 200' is merely an example; the first and second portions 218, 220 of the groove 200' may be arranged differently (e.g., to drive the follower 162' inwardly and outwardly multiple times as the peg 222 passes from one side 202 to the other 204).

FIG. 10 illustrates a differently shaped cam; here, the cam is defined by a flange 78' that extends from and is connected to the body 76 for rotation therewith. The flange 78' may include a cylindrical rail 230 supported by and be spaced from the body 76 of the recoil pulley 68 by a leg 232. FIG. 10 also illustrates a follower 162" having a groove 200" that may be complementarily sized to receive the rail 230. While the profile of the flange 78' may differ, it will be appreciated that the flange 78' may still have portions at different radial distances from the axis 70 of rotation to positively engage and drive the follower 162" in two directions.

Other cam and cam follower implementations also exist; e.g., the cam may include a flange having axial deviations. Thus, as the follower engages the rotating cam, the follower's displacement may have a longitudinal or axial component of displacement. Regardless, both radial and/or axial displacements of the follower will drive the piston 120 in the pump chamber 126.

Another implementation may include a cam having dual flanges generally parallel to one another defining a slot therebetween (e.g., the flanges having radial deviations). A complementary cam follower may not have a groove, but instead may have a pin or peg extending therefrom to engage the cam's slot thereby driving the cam follower in two directions.

An optional implementation (also shown in FIG. 10) may include the follower 162" having rollers or wheels 240 to engage the flange 78'. FIG. 10 illustrates one roller 240 located at the first wall 206 and another roller 240 located at the second wall 208' to engage the flange at the rail 230. Alternatively, the rollers 240 may be located on the bottom surface 196 of the follower 162" (e.g., to engage the leg 232) The rollers may reduce friction that would otherwise hinder rotation of the pulley and thereby require a greater force be applied to the starter rope to start the engine.

The presently described implementations can be used with systems that rotate the crankshaft when the recoil pulley 68 rotates or in systems that store potential energy when recoil pulley rotates without also simultaneously driving the crankshaft. The operation of the purging and/or priming circuit 36 may not require any separate operator/user manipulation of the purge pump; i.e., it may be automatically purged as the user pulls the starter cord. And pulling the starter cord may initiate both the engine starting and the purging and/or priming within the carburetor for more consistent and reliable full delivery of fuel-air mixture to the engine at start up.

The amount or volume of fuel that is purged and primed from the carburetor may be controlled by various design factors such as the number of number of revolutions of the pulley 68 (e.g., per pull by the user, which may be correlated to the number of piston cycles), size of the pump chamber 126 (which may affect the volume of fuel and/or air which is displaced per piston cycle), the magnitude of the radial displacement between the first and second portions 94, 96 of the flange driving portions 90 (which may be correlated to the stroke length of the piston 120), and the number of first and second portions 94, 96 on the flange 78 (which may be correlated to the number of piston strokes per revolution of the flange 78). These design factors may be calibrated as a function of the pump swept volume and pump efficiency and the volume of the carburetor passages through which fluid is pumped.

The implementations described herein have included an engine, a carburetor having a purging and priming circuit, a pump assembly having a drive member and a driven member, and a recoil starter pulley. In each of the implementations, the drive member positively drives or displaces the driven member in two directions. This bi-directional driving motion or force is transmitted to a pump device of the pump assembly which purges the carburetor of fluid and primes the carburetor with fresh fuel prior to starting the engine.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

Furthermore, spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device(s) in use or operation in addition to the orientation depicted in the figures. For example, if the device(s) in the figures is turned over, elements described as "below" or "beneath" other elements or features would then be oriented "above" the other elements or features. Thus, the exemplary term "below" can encompass both an orientation of above and below. The device(s) may be otherwise oriented (rotated 90 degrees or at other orientations) and the spatially relative descriptors used herein interpreted accordingly.

The invention claimed is:

1. A starting system for an internal combustion engine, comprising:

a pump assembly with a pump device in communication with a purging and priming circuit of a carburetor and bidirectionally movable;

a driven member coupled to the pump device; and a drive member rotatably carried by a recoil starter pulley of an engine, wherein the drive member positively drives the driven member in two directions, wherein driving the driven member directly bidrectionally moves the pump device.

2. The starting system of claim 1, wherein the pump assembly includes a pump chamber in communication with the purging and priming circuit, and the volume of the chamber is varied as the pump device is actuated to move fluid out of and/or into the purging and priming circuit.

3. A starting system for an internal combustion engine, comprising:

a pump device in communication with a purging and priming circuit of a carburetor;

a driven member coupled to the pump device;

a drive member rotatably carried by a recoil starter pulley of an engine, wherein the drive member positively drives the driven member in two directions, wherein driving the driven member actuates the pump device; and the driven member has a first cam surface and a second cam surface and the drive member engages the first cam surface of the driven member to drive the driven member in a first direction and the drive member engages the second cam surface of the driven member to drive the driven member in a second direction.

4. The starting system of claim 3, wherein at least a portion of the drive member is defined by a peg extending from the pulley, wherein the peg rotates with the pulley and engages the first and second cam surfaces of the driven member as the peg rotatably passes the driven member.

5. The starting system of claim 3, wherein the driven member is either directly coupled to the pump device or is coupled to the pump device via a Bowden cable.

6. A starting system for an internal combustion engine, comprising:

a pump device in communication with a purging and priming circuit of a carburetor;

a driven member coupled to the pump device;

a drive member rotatably carried by a recoil starter pulley of an engine, wherein the drive member positively drives the driven member in two directions, wherein driving the driven member actuates the pump device; and the drive member has a first cam surface and a second cam surface and during rotation of the drive member, the first cam surface engages the driven member to drive the driven member in a first direction and the second cam surface engages the driven member to drive the driven member in a second direction.

7. The starting system of claim 6, wherein the drive member is defined by one of a flange or a rail having one or more radial deviations for positive mechanical engagement of the driven member within a groove of the driven member.

8. The starting system of claim 7, wherein the driven member further comprises wheels that engage the flange or rail.

9. The starting system of claim 6, wherein the driven member is either directly coupled to the pump device or is coupled to the pump device via a Bowden cable.

10. A starting system for an internal combustion engine, comprising:

a pulley rotatable about an axis;

a drive member rotatable with the pulley;

a carburetor in fluid communication with the engine and having a purging and priming circuit through which fluid flows to do one or both of purge stale fluid from the carburetor and prime the carburetor with fuel;

a pump assembly having a driven member engageable with the drive member to displace the driven member as the drive member rotates with the pulley, wherein at least one of the drive member or the driven member has cam surfaces to actuate the driven member in opposed directions as the drive member rotates, and wherein the pump assembly includes a pump device that is actuated by movement of the driven member to pump fluid in the purging and priming circuit; and the pump assembly includes a pump chamber in communication with the purging and priming circuit, and the volume of the chamber is varied as the pump device is actuated to move fluid out of and/or into the purging and priming circuit.

11. The starting system of claim 10, wherein the drive member is defined at least in part by a flange having portions located at different radial distances from the axis, wherein the flange has a first cam surface and a second cam surface, wherein the driven member is engaged by the first cam surface of the drive member to drive the driven member in a first direction and the driven member is engaged by the second cam surface of the drive member to drive the driven member in a second direction.

12. The starting system of claim 10, wherein the drive member is defined by a rail having portions located at different radial distances from the axis, wherein the rail positively engages the driven member and actuates the driven member in opposing directions at the portions located at different radial distances.

13. The starting system of claim 8, wherein at least a part of the drive member is defined by a peg carried by the pulley, wherein the driven member has a first cam surface and a second cam surface, wherein the peg engages the first cam surface of the driven member to drive the driven member in a first direction and the peg engages the second cam surface of the driven member to drive the driven member in a second direction.

14. The starting system of claim 6, wherein the pulley is configured to rotate in a first direction in response to user actuation thereby actuating the driven member in a reciprocating motion, and thereafter recoil in an opposing direction thereby again actuating the driven member in the reciprocating motion.

15. A starting system for an internal combustion engine, comprising:

a pulley rotatable about an axis;

a drive member rotatable with the pulley;

a carburetor in fluid communication with the engine and having a purging and priming circuit through which fluid flows to do one or both of purge stale fluid from the carburetor and prime the carburetor with fuel; and a pump assembly having a driven member engageable with the drive member to displace the driven member as the drive member rotates with the pulley, wherein at least one of the drive member or the driven member has cam surfaces to actuate the driven member in opposed directions as the drive member rotates, and wherein the pump assembly includes a pump device that is bidirectionally movable and is bidirectionally directly driven by movement of the driven member to pump fluid in the purging and priming circuit.

* * * * *